US008051620B2

(12) United States Patent
Kittlitz et al.

(10) Patent No.: US 8,051,620 B2
(45) Date of Patent: Nov. 8, 2011

(54) JOIST HANGER FOR ICF WALL SYSTEMS

(75) Inventors: Lavern Kittlitz, Lindbergh (CA); RubyAnn Kittlitz, Lindbergh (CA)

(73) Assignee: Lavann ICF Hangers Inc.

( * ) Notice: Subject to any disclaimer, the term of this patent is extended or adjusted under 35 U.S.C. 154(b) by 114 days.

(21) Appl. No.: 12/507,768

(22) Filed: Jul. 22, 2009

(65) Prior Publication Data

US 2010/0064626 A1 Mar. 18, 2010

Related U.S. Application Data

(60) Provisional application No. 61/083,024, filed on Jul. 23, 2008.

(51) Int. Cl.
*E04B 1/38* (2006.01)

(52) U.S. Cl. ..... 52/702; 52/93.1; 52/289

(58) Field of Classification Search ..... 52/702, 52/704, 12, 714, 715, 745.21, 93.1, 289
See application file for complete search history.

(56) References Cited

U.S. PATENT DOCUMENTS

| | | | | |
|---|---|---|---|---|
| 1,692,351 | A | 11/1928 | Ropp | |
| 1,785,791 | A | 12/1930 | Ropp | |
| 4,802,786 | A * | 2/1989 | Yauger et al. | 403/232.1 |
| 5,228,261 | A * | 7/1993 | Watkins | 52/702 |
| 6,131,358 | A | 10/2000 | Wise | |
| 6,845,594 | B2 | 1/2005 | Harber | |
| 7,024,833 | B1 | 4/2006 | Rice | |
| 2005/0066613 | A1 | 3/2005 | Bourque | |
| 2005/0155307 | A1 * | 7/2005 | Timony | 52/506.01 |
| 2006/0059846 | A1 | 3/2006 | Rice | |
| 2006/0059847 | A1 | 3/2006 | Rice | |

FOREIGN PATENT DOCUMENTS

| | | | |
|---|---|---|---|
| GB | 2185047 | A | 7/1987 |
| GB | 2397589 | B | 12/2004 |

OTHER PUBLICATIONS

Clark Ricks, "Installing Floor Joists", ICF Builder Magazine (internet article) 4 pages.

(Continued)

*Primary Examiner* — Brian Glessner
*Assistant Examiner* — Patrick Maestri

(57) ABSTRACT

A hanger for supporting joists or beams in insulated concrete formwork (ICF) systems has two parallel side plates having inner and outer sections, plus an L-shaped support member comprising a horizontal leg extending between the lower edges of the outer sections of the side plates, and an upward-extending vertical leg which demarcates the inner and outer side plate sections. The inner sections of the side plates are passed through slits in one insulation panel of an ICF wall-forming system, until the support member's vertical leg abuts the outer face of the insulation panel, leaving the side plate inner sections extending partially into the formwork cavity. The joist or beam to be supported may be set on the horizontal leg of the support member either before or after the concrete wall is cast. Preferably, an cut-out is made in the insulation panel behind the vertical leg of the support member to allow concrete to flow against the vertical leg and the supported joist or beam is cut for a close fit against the vertical leg, such that external horizontal loads on the wall can pass into the joist or beam by direct compression.

7 Claims, 4 Drawing Sheets

OTHER PUBLICATIONS

ICF Connect Ltd., Floor Joist Span and Wood Floor Truss Details (2 pages).
Dean Isaacson, "ICF Hanging Ledgers", Cougar Gulch Group, LLC (internet article) (1 page).
ICF-Connect Ltd., "The ICF-Connector"(brochure) (4 pages).
Logix Insulated Concrete Forms, Product Manual/Installation Guide, Sections 2.12 to 2.15, Sep.-Nov. 2004 (28 pages).
ARXX Corporation, Simpson Strong-Tie ICF Ledger Connector System (brochure), 3 pages.

* cited by examiner

JOIST HANGER FOR ICF WALL SYSTEMS

CROSS-REFERENCE TO RELATED APPLICATION

This application claims the benefit, pursuant to 35 U.S.C. 119(e), of U.S. Provisional Application No. 61/083,024, filed on Jul. 23, 2008, and said provisional application is incorporated herein by reference in its entirety.

FIELD OF THE INVENTION

The present invention relates in general to support hardware for structural joists an beams, and relates in particular to joist and beam hangers for use in association with concrete walls constructed using insulated concrete formwork systems.

BACKGROUND OF THE INVENTION

It is increasingly common for both below-grade and above-grade concrete walls to be constructed using insulated concrete formwork (or "ICF") systems. In conventional concrete wall-forming systems, a pair of wood or metal form panels are set up at a spacing corresponding to the desired thickness of the finished wall, thus creating a cavity between the panels. As necessary or desired, steel reinforcing bars are positioned within the formwork cavity. The form panels are secured in position using form ties extending between the form panels, and/or by means of external temporary bracing. Fluid concrete is then introduced into the formwork cavity. After the concrete has cured sufficiently, the formwork panels are removed (or "stripped") from the concrete wall.

It is generally desirable to in insulate both above-grade and below-grade building walls, in order to minimize through-wall heat transfer both from inside the building to the outside (e.g., during winter) and from the outside into the building (e.g., during summer). By minimizing heat transfer, wall insulation reduces heating costs in cold weather, and reduces air conditioning costs in warm weather (or enhances the comfort of persons in buildings that do not have air conditioning). For concrete walls constructed using conventional methods, insulation is typically applied to one or both wall surfaces, such as in the form of plastic foam insulation panels glued or otherwise attached to the concrete surface, or (particularly in the case of inside wall surfaces) in the form of fiberglass batts incorporated into stud walls or strapping systems installed adjacent to the wall surface. These conventional wall insulation methods and systems add to the total time and cost of building construction.

ICF systems combine plastic foam insulation panels and spacing means (such as plastic the members) to create assemblies in which the insulation panels take the place of conventional wall form panels (e.g., plywood forms), and remain in place as permanent insulation after the concrete wall has been cast and cured. ICF systems thus reduce or eliminate the need to strip forms from the finished wall, thereby reducing construction labour costs. As well, construction time and costs are further reduced because wall insulation does not have to be installed as a separate task subsequent to wall construction.

It is commonly necessary or desirable for floor (or roof) beams and joists to act as struts providing effective lateral bracing to the walls that support them. In some cases, such bracing action may be structurally required on a long-term basis; in other (and perhaps most) cases, the beams and joists may need to provide bracing only until the complete floor (or roof) structure is in place. This bracing effectiveness is easily achieved in conventional concrete wall construction by embedding the supported ends of the beams and joists into the walls as the walls are being cast, thus providing solid support for the beams and joists both vertically and laterally. However, it is somewhat difficult to embed beams and joists in concrete walls formed using ICF systems. This would typically require cutting out sections of insulation to accommodate the beams and joists, and in some cases temporary shoring may be needed because the ICF panels may not be strong enough to support the weight of the embedded beams and joists during wall construction.

For these reasons, a variety of joist and beam hanger designs have been developed for use with ICF systems. One known ICF joist hanger system, the ICF-Connector™ made by ICF-CONNECT Ltd. of Woodbridge, Ontario, uses a pair of flat metal side plates that are inserted partway through corresponding and suitably spaced vertical slots in an ICF form panel, such that an inner portion of each plate will be east into the concrete wall and an outer portion will protrude from the outer face of the form panel. After the concrete wall has been cast, a U-shaped metal bracket is positioned under the end of the joist to be supported. The joist end is then positioned between the protruding side plates, and suitable fasteners (e.g., sheet metal screws) are installed to connect both side plates to the vertical legs of the U-shaped bracket. Because the side plates are rigidly anchored in the concrete wall, their connection to the bracket allows the hanger assembly to transfer loads both vertically and laterally between the joist and the concrete wall (subject to proper structural design of the hanger components and fasteners).

However, all load transfer in such hanger systems is by way of shear across the fasteners. If the fasteners are corroded, insufficiently tight, or installed in oversized holes, the hanger assembly's bi-directional load transfer capability can be seriously compromised. Accordingly, there is a need for an ICF joist hanger that provides secure bi-directional load transfer capability without relying on shear-loaded fasteners, and without requiring extensive cutouts in the ICF form panels. Moreover, there is at need for such an ICF hanger of unitary or one-piece construction, to minimize hanger fabrication costs. The present invention is directed to these needs.

BRIEF SUMMARY OF THE INVENTION

The present invention provides a hanger specially adapted for supporting joists or beams in association with concrete walls constructed using insulated concrete formwork (ICF) systems. In preferred embodiments, the hanger has a pair of typically parallel side plates each having inner and outer sections, plus a generally L-shaped support member comprising a typically horizontal base leg extending between the lower edges of the outer sections of the side plates and an upward-extending vertical leg which demarcates the inner and outer sections of the side plates. The hanger may be mounted to an ICF wall-forming system by passing the inner sections of the side plates through slits cut or otherwise formed in one of the ICF insulation panels, until the vertical leg of the support member abuts the outer face of the insulation panel, such that the inner sections of the side walls extend partially into the cavity between the ICF insulation panels and thus will be cast into the finished concrete wall. Preferably, the inner sections of the side plates will have openings through which reinforcing bars can be inserted for enhanced anchorage of the hanger in the concrete wall.

After the concrete wall has been cast and cured, one end of the joist or beam to be supported is set onto the base leg of the support member. Alternatively, the joist or beam can be supported on the base leg (and temporarily shored if necessary) prior to placing concrete in the ICF system. In either scenario, nails, screws, or other fasteners may optionally be used to connect the joist or beam to the hanger, and for this purpose the hanger may optionally have fastener holes in the outer sections of the side plates and/or in the base leg. However, such fasteners are not necessary for vertical support of the joist or beam, since all vertical joist or beam reactions are transferred directly into the concrete well through the base leg and the side plates.

In another aspect, the invention provides methods of supporting a joist or beam in association with an ICF-formed concrete wall, using a hanger as described and illustrated. In preferred methods of using the hanger, an opening will be formed in the insulation panel behind the vertical leg of the support member such that when the wall is being cast, concrete will flow into the panel opening and against the vertical leg. As well, the supported joist or beam will be cut for a close fit against the outer face of the vertical leg. Therefore, external horizontal loads acting on the wall (such as from backfill pressure) can be transferred from the wall into the joist or beam by direct compression, without need for fasteners connecting the joist or beam to the hanger.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
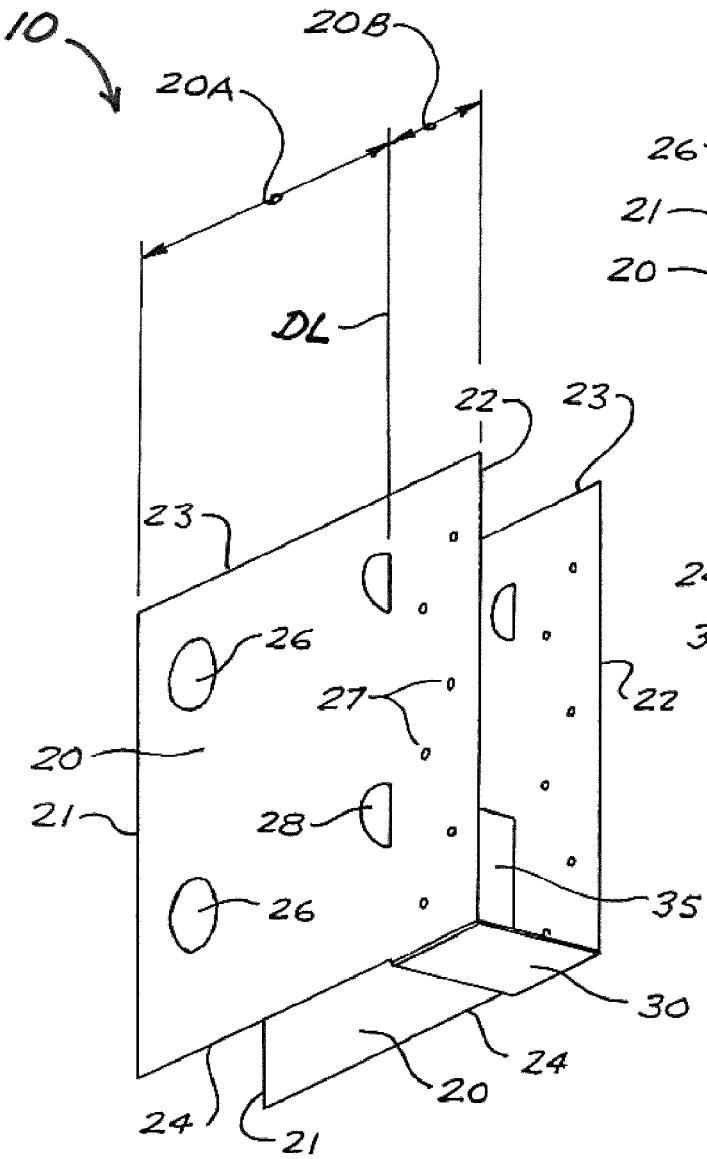
FIG. 1 is an isometric view of a joist/beam hanger in accordance with a first embodiment of the present invention.
Figure 2:
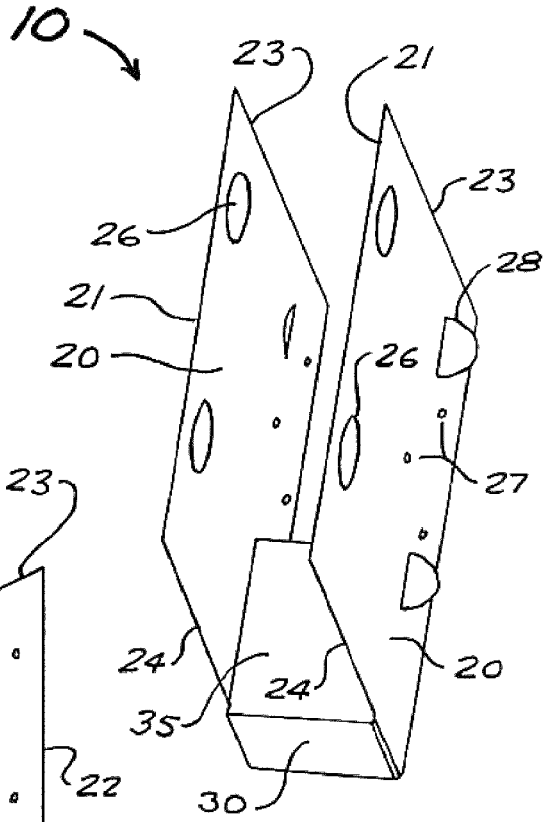
FIG. 2 is a further isometric view of the hanger shown in FIG. 1.

FIGS. 1 and 2 are isometric views of an ICF joist hanger in accordance with a first embodiment of the present invention, in the form of a one-piece joist hanger 10 having:

- a pair of spaced side plates 20, each having an inner edge 21, an outer edge 22, an upper edge 23, and a lower edge 24, with each side plate 20 being subdivided into an inner section 20A and an outer section 20B (by a notional and typically vertical demarcation line DL); and
- a generally L-shaped support member comprising:
  - a base leg 30 extending widthwise between the lower edges 24 of outer sections 20B of side plates 20; and
  - as vertical leg 35 extending upward from base leg 30 along demarcation line DL, and having an outer face 35A and an inner face 35B.

In typical cases, vertical leg 35 will be perpendicular to base leg 30, and also perpendicular to both side plates 20 (which in turn will be parallel to each other in typical cases). In special cases, however, vertical leg 35 may be other than perpendicular to base leg 30 (such as when a supported beam or joist is not horizontal, and when for that reason base leg 30 is not perpendicular to the wall). In the case of a skewed connection (i.e., where a supported beam or joist, as view in plan, is not perpendicular to the supporting wall), vertical leg 35 may be other than perpendicular to side plates 20.

Figure 3:
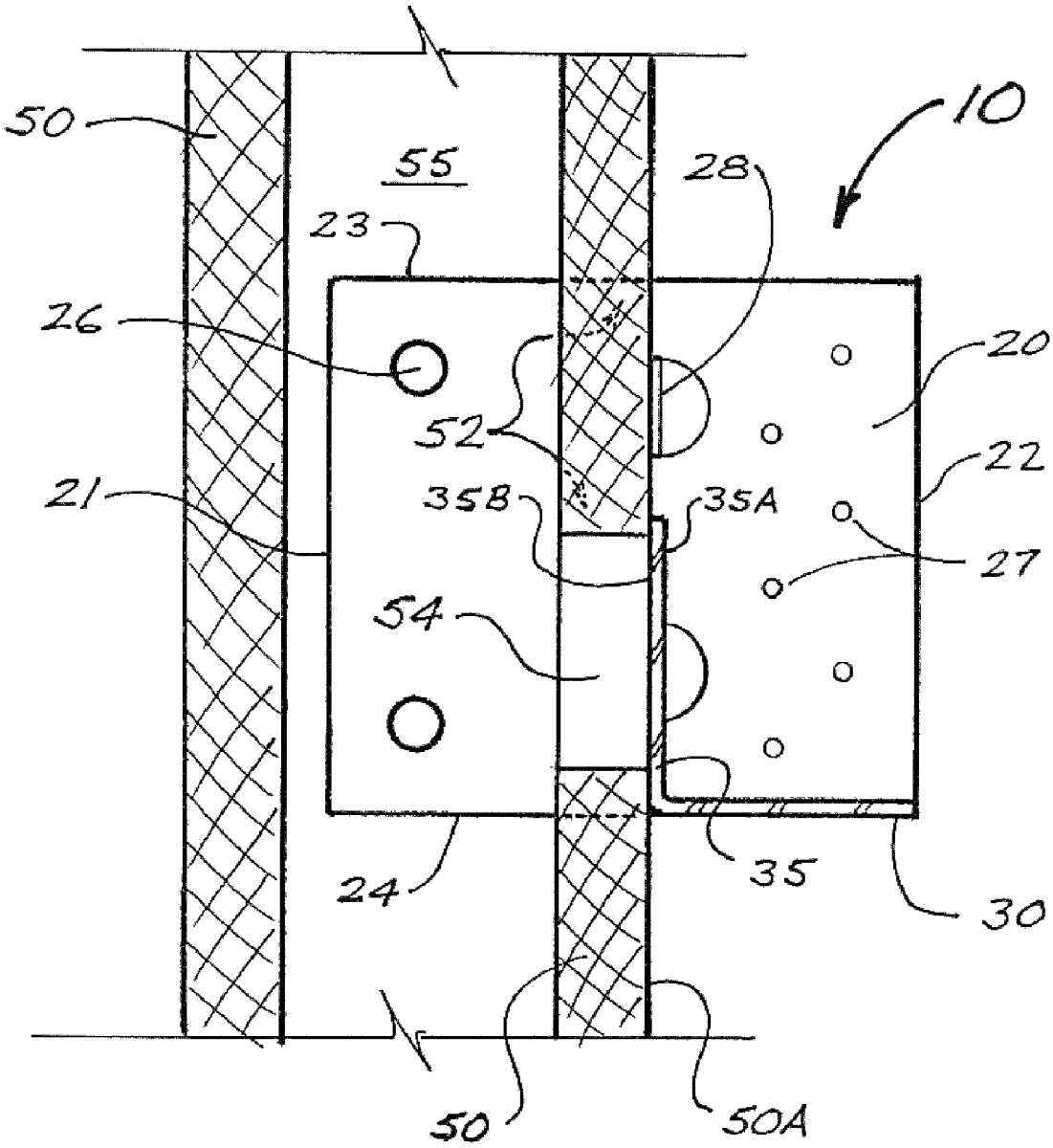
FIG. 3 is a cross-section through a hanger of a type as shown in FIGS. 1 and 2, shown installed in a typical ICF formwork assembly prior to concrete placement.
Figure 4:
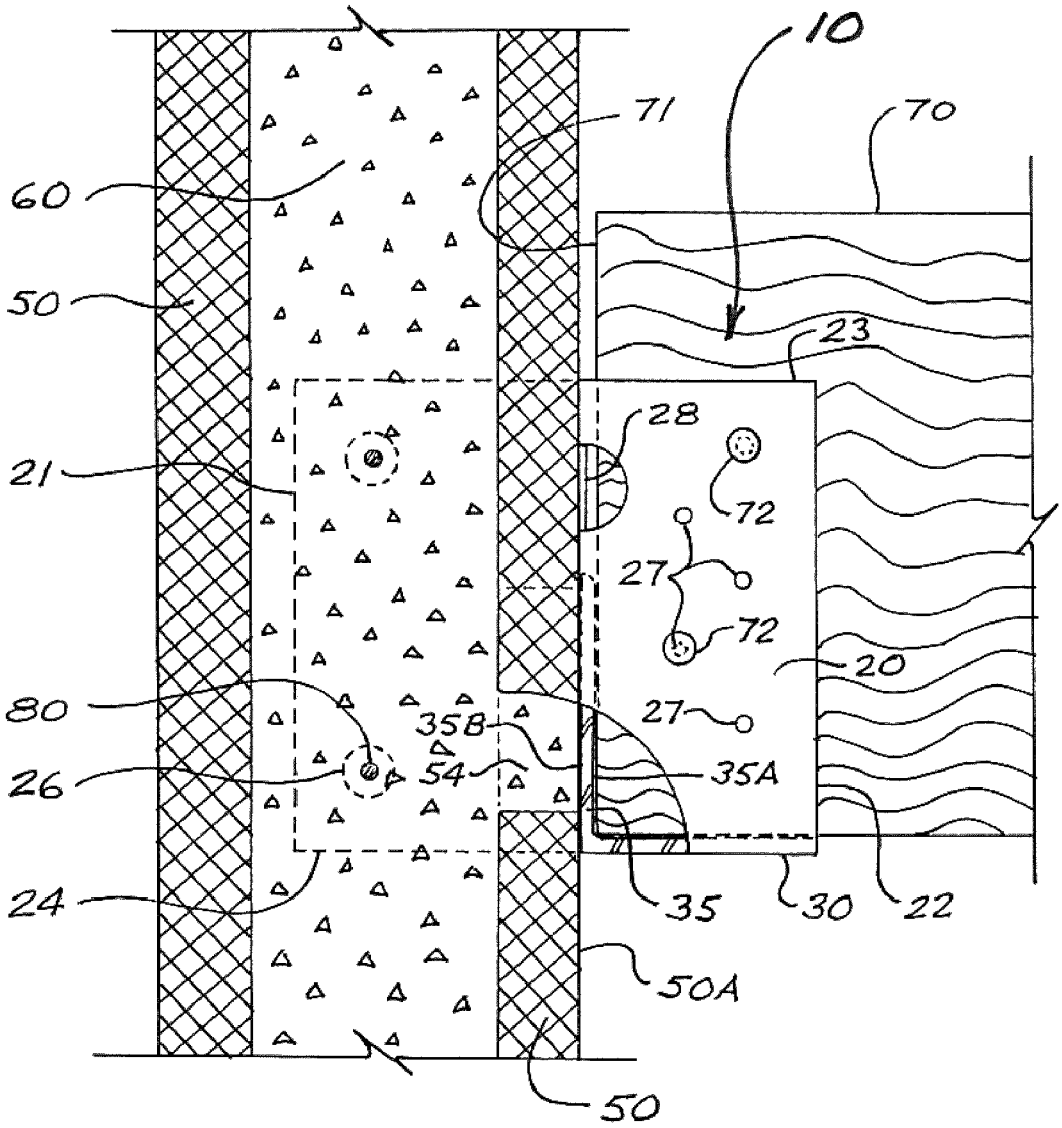
FIG. 4 is a cross-section through a concrete wall constructed using ICF formwork with a hanger cast into the concrete wall as in FIG. 3, with a structural wood joist mounted in the hanger.

The installation and use of hangers 10 in conjunction with ICF formwork systems may be readily understood with reference to FIGS. 3 and 4. FIG. 3 is a cross-section through a hanger 10 in accordance with the present invention, installed in a typical ICF formwork assembly prior to concrete placement. FIG. 4 is a cross-section through a concrete wall 60 constructed using ICF formwork, showing a structural wood joist 70 mounted in a hanger 10 cast into wall 60.

As shown in FIGS. 3 and 4, the ICF assembly comprises a pair of rigid insulation form panels 50 spaced apart to form a cavity 55 having a width corresponding to the desired thickness of the finished concrete wall. Two parallel vertical slits 52, spaced to match the distance between side plates 20 of hanger 10, are cut into the appropriate form panel 50 at each desired joist (or beam) location in the finished wall. A hanger 10 is then installed at each location by inserting side plates 20 through the corresponding slits 52 (inner edges 21 first) until, vertical leg 35 abuts or is substantially aligned with outer face 50A of the corresponding form panel 50.

As best seen in FIG. 3, an opening 54 is preferably cut into form panel 50 in the area behind each vertical leg 35 such that concrete placed within formwork cavity 55 will flow up against inner face 35B of vertical legs 35. Preferably, form panel openings 54 will be of generally rectangular shape corresponding to but slightly smaller than vertical leg 35. This configuration of openings 54 maximizes the area of concrete contact against vertical legs 35 while preventing or minimizing leakage of fluid concrete.

In preferred embodiments, at least one side plate 20 of hanger 10 is formed with one or more tabs 28 extending outward from (and typically but not necessarily perpendicular to) side plate 20 and positioned for alignment with outer face 50A of the form panel 50 (i.e., with the plane of each tab 28 generally coinciding with notional demarcation line DL). As best seen in FIG. 4, tabs 28 make it easier for construction workers to ensure that hangers 10 are plumb after installation in form panels 50 and that side plates 20 of hangers 10 project the appropriate distance into formwork cavity 55; it is simply a matter of pushing side plates 20 through slits 52 until tabs 28 abut outer face 50A. The precise position of tabs 28 in side plates 20 of a given hanger 10 will depend on the thicknesses of form panels 50 and concrete wall 60.

In the preferred embodiments shown in the Figures, each side plate 20 of hanger 10 has one or more openings 26 proximal to inner edge 21 such that when hanger 10 is installed in association with an ICF formwork assembly, openings 26 will be disposed within formwork cavity 55. Reinforcing bars 80 inserted through openings 26 will therefore become cast into concrete wall 60, thereby enhancing the strength and security of the hanger's anchorage within the finished wall.

Each side plate 20 of hanger 10 preferably has multiple fastener holes 27 to allow installation of fasteners 72 (for example, wood screws or spikes) through side plates 20 into wood joist (or beam) 70. As will be readily appreciated by persons skilled in the art, fasteners 72 will typically be subject to little or no structural loading in the completed structure. In fact, the use of fasteners 72 is not essential to proper installation of joists and beams in association with hangers 10, although it will often be convenient to use at least one or two fasteners 72 to facilitate initial joist (or beam) installation and positioning. In an alternative embodiment, hanger 10 has one or two fastener holes 27 in base leg 30 (in lieu of or in addition to holes 27 in side plates 20), allowing fasteners 72 to be installed upward into the bottom of joist 70.

For optimal structural effectiveness of the joist/hanger connection, joist 70 will preferably be cut to length such that after installation in hanger 10, a lower portion of the vertical end face 71 of joist 70 will be substantially in contact with outer face 35A of vertical leg 35. Since inner face 35B of vertical leg 35 is in direct contact with concrete wall 60 (by virtue of concrete flowing into panel openings 54 as previously described), lateral loads can thus be transferred by direct compression between joist 70 and wall 69.

Although the installation and use of hangers 10 have been described in the context of solid wood joists and beams, persons skilled in the art will appreciate that hanger installation methods can be readily adapted to accommodate other types of structural members including light wood trusses, I-shaped wood joists (e.g., TJI® joists), cold-formed channels, and even hot-rolled steel members.

Hangers 10 will preferably be fabricated from galvanized steel or stainless steel. However, the invention is not limited or restricted to the use of any particular material, and other structurally suitable materials may be used without departing from the scope of the invention.

Figure 5:
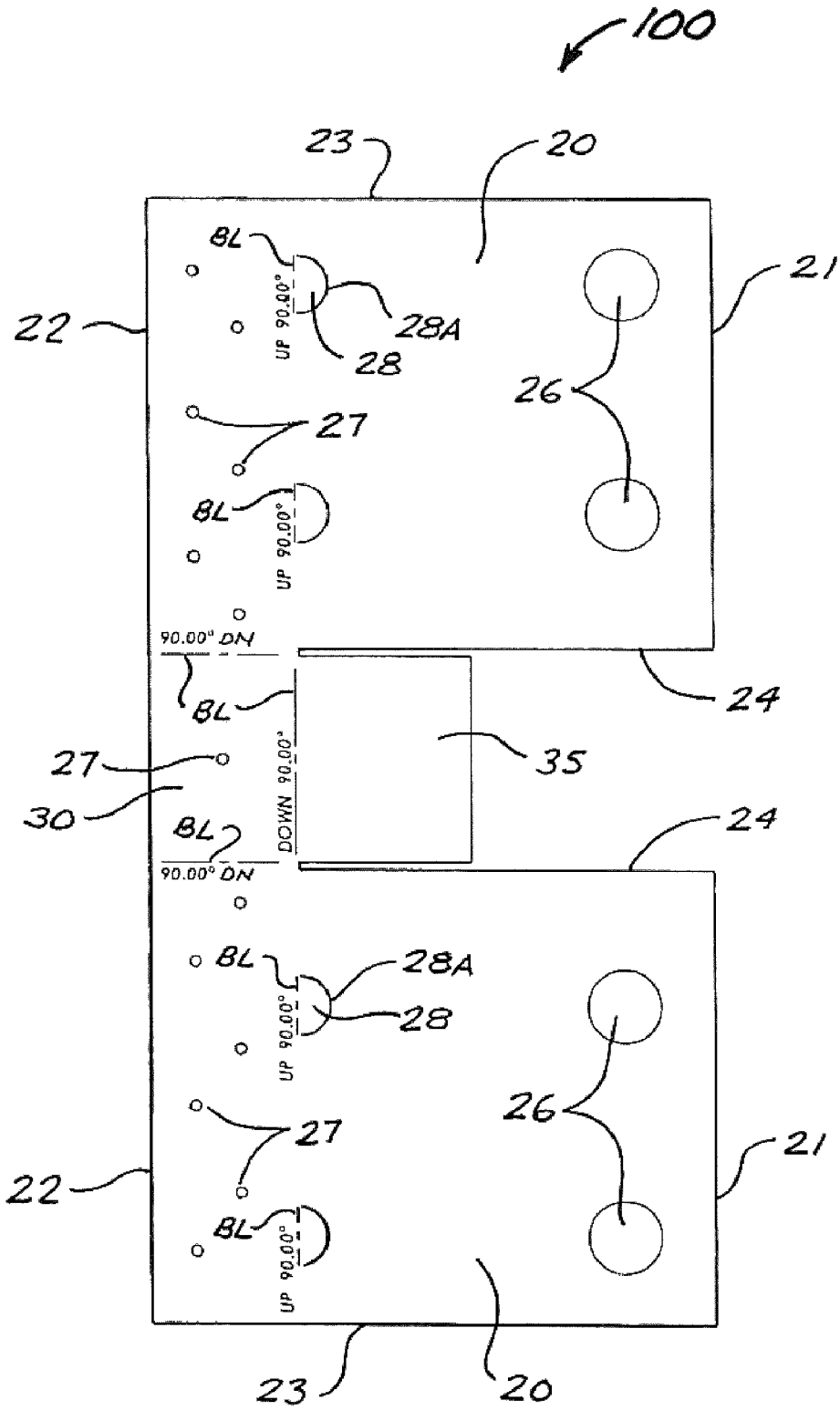
FIG. 5 illustrates a piece of flat stock which has been cut for brake-forming into a one-piece hanger in accordance with the present invention.

Hangers 10 will preferably be of unitary construction. FIG. 5 illustrates one way of doing this using a hanger blank 100 from suitable flat stock, with pre-cut rebar openings 26, fastener holes 27, and slits 28A for tabs 28 as desired or required. It is then a simple matter of forming hanger 10 in its final configuration by making bends in blank 100 along bend lines BL as indicated, using a conventional metal-working brake or other suitable equipment.

Alternatively, of course, hanger 10 could also be fabricated from multiple subcomponents, such as by welding.

It will be readily appreciated by those skilled in the art that various modifications of the present invention may be devised without departing from the scope and teaching of the present invention, including modifications which may use equivalent structures or materials hereafter conceived or developed, and all such modifications are intended to come within the scope of the present invention and the claims appended hereto. It is to be especially understood that the invention is not intended to be limited to described or illustrated embodiments, and that the substitution of a variant of a claimed element or feature, without any substantial resultant change in the working of the invention, will not constitute a departure from the scope of the invention. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure. Relational terms such as "parallel", "perpendicular", "coincident", "intersecting", and "equidistant" are not intended to denote or require absolute mathematical or geometrical precision. Accordingly, such terms are to be understood as denoting or requiring substantial precision only (e.g., "substantially parallel") unless the context clearly requires otherwise.

What is claimed is:

1. A joist hanger for use with ICF formwork systems, said joist hanger comprising:

(a) a pair of spaced side plates, each having an inner edge, an outer edge, an upper edge, and a lower edge, and each side plate comprising an inner section adjacent the side plate's inner edge and an outer section adjacent the side plate's outer edge; and (b) a generally L-shaped support member comprising:

b.1 a base leg fixed to and extending between the lower edges of the outer sections of the side plates; and b.2 a vertical leg extending upward from said base leg, and having an outer face and an inner face;

wherein the inner and outer sections of the side plates are demarcated by the plane of the vertical leg.

2. The joist hanger of claim 1 wherein the outer section of at least one side plate has one or more fastener holes.

3. The joist hanger of claim 1 wherein the base leg of the support member has one or more fastener holes.

4. The joist hanger of claim 1 wherein the inner section of each side plate has one or more openings, said one or more openings being configured to permit insertion of a reinforcing bar.

5. The joist hanger of claim 1 wherein at least one sidewall has at least one tab extending perpendicularly outward from the sidewall, with the plane of said at least one tab being coincident with the plane of the vertical leg.

6. The joist hanger of claim 1 wherein said joist hanger is fabricated from a material comprising galvanized steel.

7. The joist hanger of claim 1 wherein said joist hanger is of unitary construction.

* * * * *